US006333751B1

(12) United States Patent
Torii et al.

(10) Patent No.: US 6,333,751 B1
(45) **Date of Patent: *Dec. 25, 2001**

(54) MULTISCANNING TYPE DISPLAY APPARATUS

(75) Inventors: Hiromitsu Torii, Kamakura; Hirokatsu Yui, Fujisawa; Yoshikuni Shindo, Sapporo, all of (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/005,185

(22) Filed: Jan. 9, 1998

(30) Foreign Application Priority Data

Jan. 10, 1997 (JP) ..... 9-014756

(51) Int. Cl.[7] ..... G09G 5/00
(52) U.S. Cl. ..... 345/698; 345/213; 345/131
(58) Field of Search ..... 345/213, 131, 345/132, 698

(56) References Cited

U.S. PATENT DOCUMENTS

| | | | |
|---|---|---|---|
| 5,550,556 | 8/1996 | Wu et al. | 345/14 |
| 5,926,174 * | 7/1999 | Shibamiya et al. | 345/213 |

FOREIGN PATENT DOCUMENTS

| | | |
|---|---|---|
| 0725379 | 8/1996 | (EP) . |
| 0794525 | 9/1997 | (EP) . |
| 7199855 | 8/1995 | (JP) . |
| 8137444 | 5/1996 | (JP) . |
| 8166776 | 6/1996 | (JP) . |
| 09247574 | 9/1997 | (JP) . |
| 09247588 | 9/1997 | (JP) . |
| 93/15497 | 8/1993 | (WO) . |

OTHER PUBLICATIONS

An English Language abstract of JP 8–137444.
An English Language abstract of JP 7–199855.
An English Language abstract of JP 8–166776.
Copy of an English Language Abstract of JP No. 9–247574.
Copy of an English Language Abstract of JP No. 9–247588.

* cited by examiner

*Primary Examiner*—Richard Hjerpe
*Assistant Examiner*—Duc Q Dinh
(74) *Attorney, Agent, or Firm*—Greenblum & Bernstein, P.L.C.

(57) ABSTRACT

The invention relates to a multiscanning type display apparatus having a matrix drive type display device for displaying picture signals, a picture signal supplying section for supplying picture signals to the display device, a synchronization signal supplying section for outputting synchronization signals included in the above mentioned picture signals, and a resolution power converting section for converting the resolution of the above mentioned picture signals to the resolution of the above mentioned display device.

4 Claims, 5 Drawing Sheets

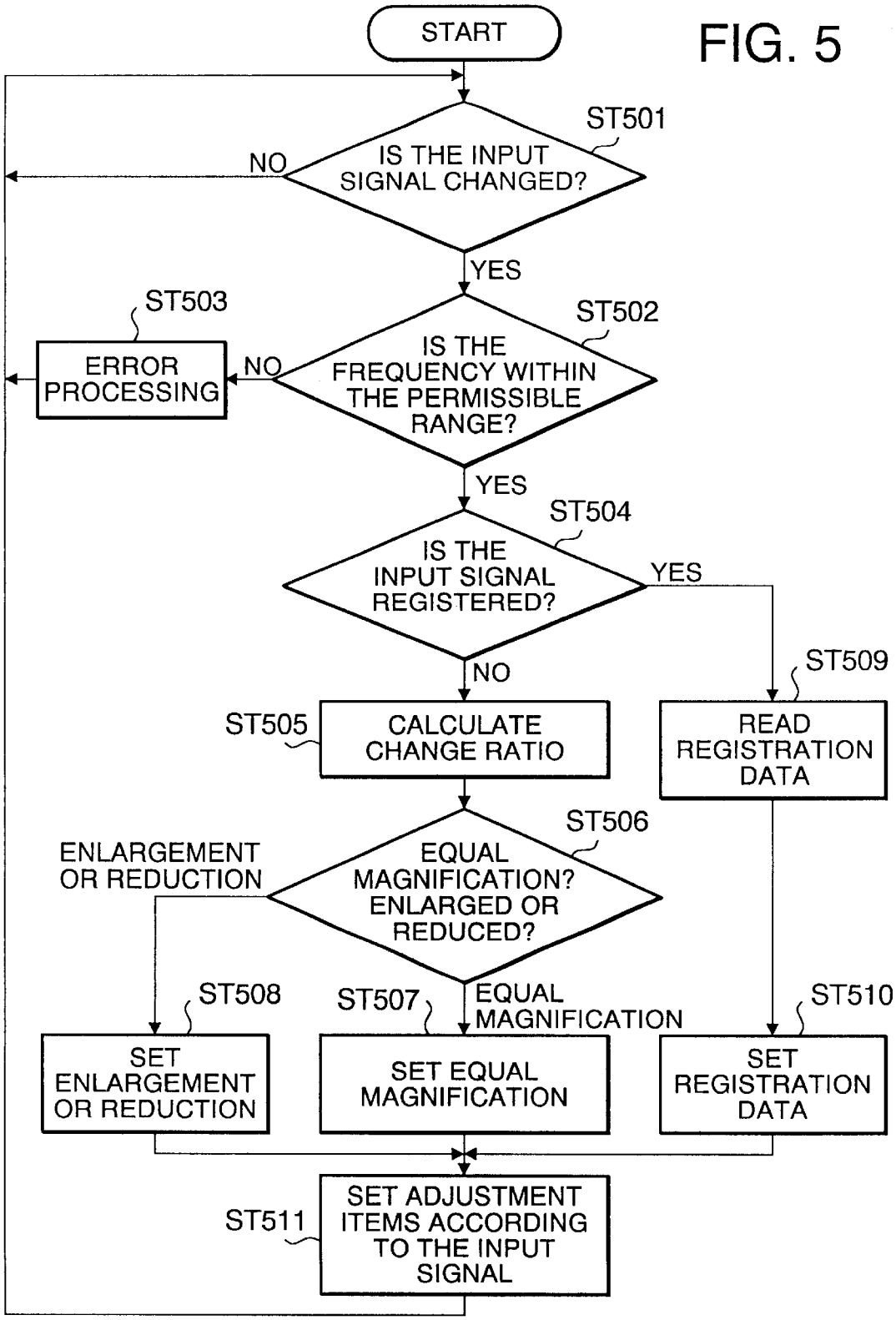
START
FIG. 5
ST501
IS THE INPUT SIGNAL CHANGED?
NO
YES
ST503
ERROR PROCESSING
NO
ST502
IS THE FREQUENCY WITHIN THE PERMISSIBLE RANGE?
YES
ST504
IS THE INPUT SIGNAL REGISTERED?
YES
NO
ST509
READ REGISTRATION DATA
ST505
CALCULATE CHANGE RATIO
ST506
ENLARGEMENT OR REDUCTION
EQUAL MAGNIFICATION? ENLARGED OR REDUCED?
ST508
SET ENLARGEMENT OR REDUCTION
ST507
EQUAL MAGNIFICATION
SET EQUAL MAGNIFICATION
ST510
SET REGISTRATION DATA
ST511
SET ADJUSTMENT ITEMS ACCORDING TO THE INPUT SIGNAL

MULTISCANNING TYPE DISPLAY APPARATUS

BACKGROUND OF THE INVENTION

1. Field of the Invention

The present invention relates to a display apparatus such as a liquid crystal display, plasma display, etc., and in particular to a display device especially called a multiscanning type display apparatus, which is able to display picture signals of a plurality of signal standards.

2. Description of the Related Art

Since in a multiscanning type CRT display, etc., the size of one dot in a picture when displaying input signals is variable, it is possible to display input signals on a full screen by adequately changing the resolution regardless the signal standards of input signal.

On the other hand, in a case where input signals are displayed on a matrix drive type display device such as a plasma display panel, etc., since the size of display pixels and number of pixels of a picture screen of those display devices are fixed, there are some limitations in input signals which can be displayed in a case where the resolution of the display device is different from that of the input signals. For example, there are some types in which the input signals having the same resolution as that of the liquid crystal display device can be displayed, and input signals can be displayed as they are, with respect to only signals having any smaller resolution than that.

However, there is an inconvenience if a display device can meet only the input signals having the same resolution as that of the display device, and with a method of displaying input signals at the resolution thereof in a case where the resolution of input signals is less than that of the display device, the size of picture signals to be displayed on a display device will differ depending upon the resolution of input signals, it is not convenient.

SUMMARY OF THE INVENTION

The present invention was developed in view of the above mentioned situations, and it is therefore an object of the invention to provide a multiscanning type display apparatus which is able to display input signals at the full screen at the resolution of the display device at all times with respect to a plurality of input signals, even in a matrix drive type display device such as a liquid crystal display panel, plasma display panel, etc.

The multiscanning type display apparatus of invention has a construction comprising of a matrix drive type display device which is able to display picture signals, picture supplying means which supplies picture signals to the display device, synchronization signal supplying means which outputs synchronization signals included in the above mentioned picture signals, and resolution changing means which changes the resolution of the above mentioned picture signals to the resolution of the above mentioned display device. In multiscanning type display apparatus of the present invention, an image having the predetermined resolution obtained by the input picture signal is converted to an image having the resolution a matrix type display device.

With the above mentioned construction, it is possible to display input signals having any resolution at the full screen, matching the resolution of a display device at all times.

BRIEF DESCRIPTION OF THE DRAWINGS

FIG. 5 is a flow chart to explain the function of a fourth preferred embodiment of a multiscanning type display apparatus according to the invention.

DESCRIPTION OF THE PREFERRED EMBODIMENTS

The preferred embodiments of the invention will be described with reference to the accompanying drawings.

(Embodiment 1)

Figure 1:
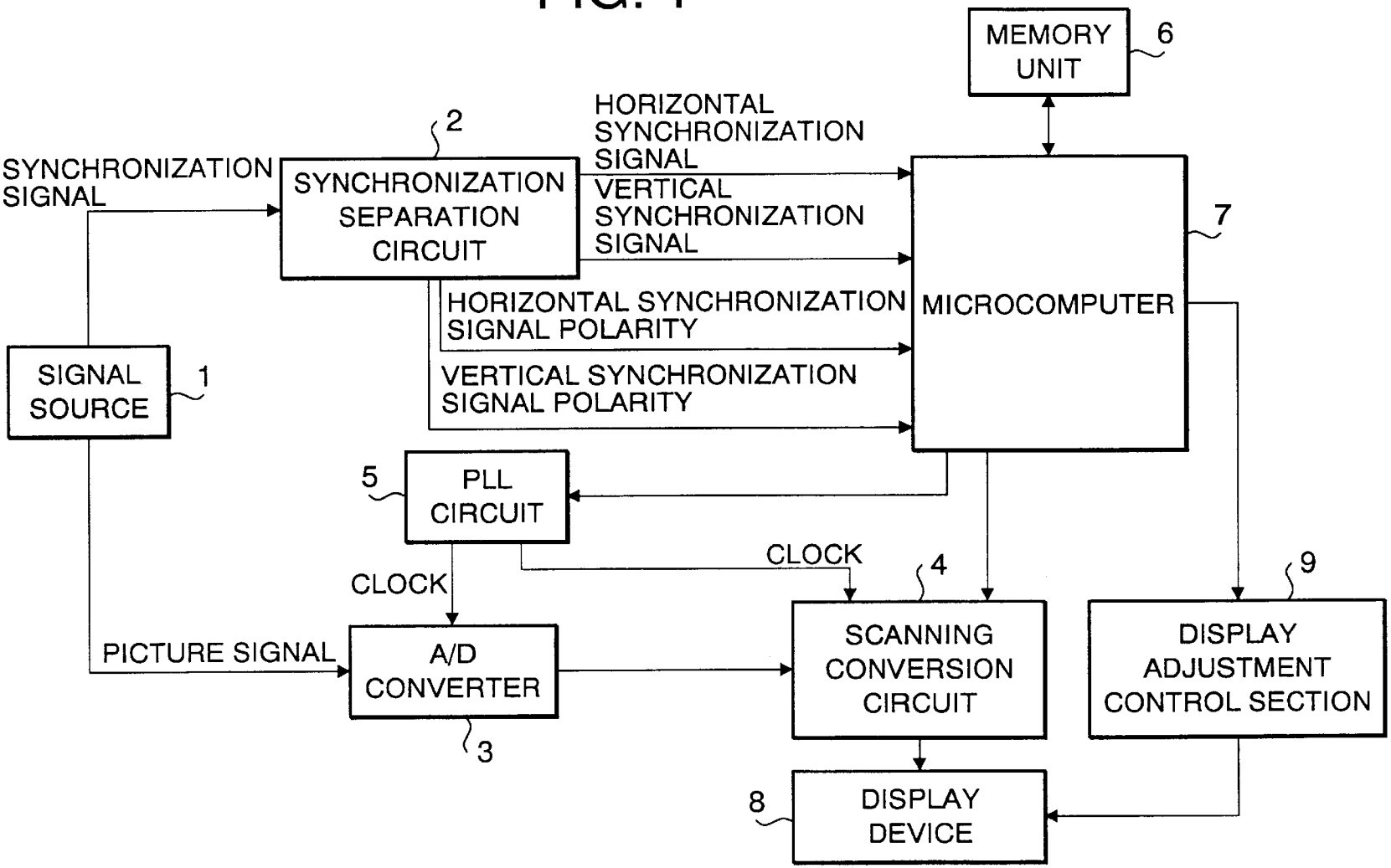
FIG. 1 is a block diagram of a multiscanning type display apparatus according to a preferred embodiment of the invention.
Figure 2:
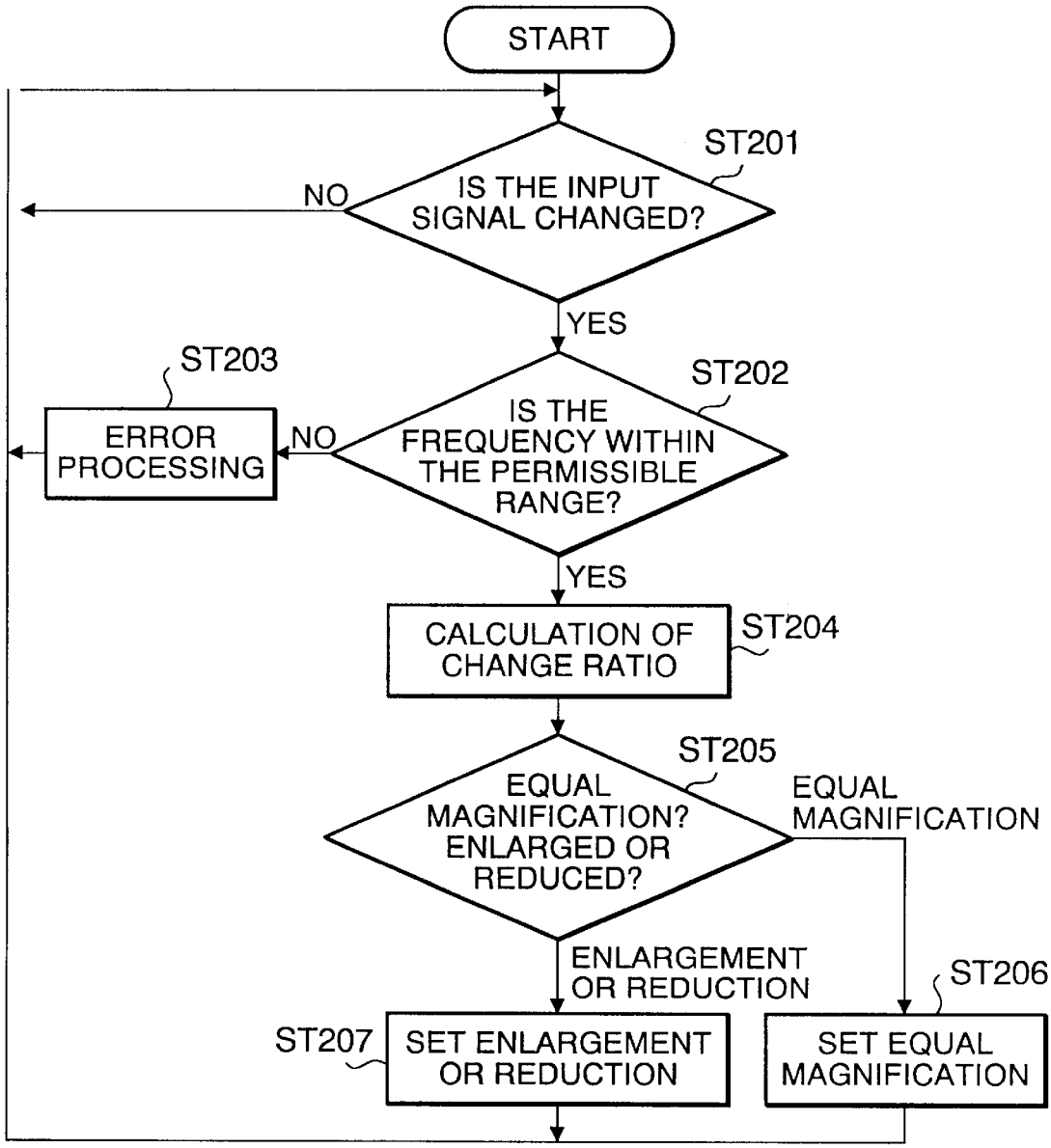
FIG. 2 is a flow chart to explain the function of a first preferred embodiment of a multiscanning type display apparatus according to the invention.

Referring FIG. 1 and FIG. 2, there is shown the first preferred embodiment of the present invention.

FIG. 1 is a block diagram of a multiscanning type display apparatus according to the first preferred embodiment of the invention. In FIG. 1, a signal source 1 such as a computer, etc., outputs input signals. A synchronization separating circuit 2 separates horizontal synchronization signals and vertical synchronization signals from the input signals, detects the horizontal synchronization polarity and vertical synchronization polarity and outputs the polarity information. An A/D converter 3 converts analog RGB picture signals of the input signals to digital RGB picture signals. A scanning conversion circuit 4 converts the input signals to a desired resolution. With regard to conversion in the horizontal direction, the scanning conversion circuit 4 can be achieved by, for example, a horizontal number-of-pixel conversion circuit disclosed by Japanese patent application serial Number. 08-49937, and with regard to conversion in the vertical direction, the scanning conversion circuit 4 can be achieved by, for example, a scanning line conversion unit, etc., disclosed by Japanese patent application serial Number. 08-48605. A PLL circuit 5 generates sampling clocks for the above mentioned A/D converter 3 and the above mentioned conversion circuit 4. A memory unit 6 stores information necessary for conversion. A microcomputer 7 reads data regarding the conversion of resolution from the above mentioned memory unit 6 and establishes various kinds of control data in the above mentioned PLL circuit 5, the above mentioned scanning conversion circuit 4, and display adjustment control section 9 while the same detects the horizontal frequency and vertical frequency from the horizontal synchronization signals and vertical synchronization signals and detects the polarity information. Furthermore, a matrix drive type display device such as liquid crystal display panel, etc., inputs picture signals from the scanning conversion circuit 4 and displays the same. The picture signals are caused to superpose by controlling the display adjustment control section 9, and the display condition can be adjusted while various kinds of adjustment items are displayed on a screen.

Next, a description is given of function of the multiscanning type display apparatus constructed as described above will be described as follows:

FIG. 2 is a flow chart to explain function of the first preferred embodiment of the invention. Horizontal synchronization signals and vertical synchronization signals are extracted by the synchronization separation circuit 2 from signals inputted from signal source 1 such as a computer, etc., and are inputted into a microcomputer 7. Furthermore, the polarity of horizontal synchronization signals and polarity of vertical synchronization signals are extracted and inputted. The microcomputer 7 into which these signals are inputted firstly detects the horizontal frequency, vertical frequency, horizontal synchronization signal polarity, and horizontal synchronization signal polarity of the input signal from the horizontal synchronization signals and vertical synchronization signals and checks to see whether or not the input signal changes (ST201). Unless the input signal changes, this check is repeated. Furthermore, when the power switch of a display device is turned on, it is regarded as the input signal being changed.

If the input signal has changed, it is checked whether or not the newly detected horizontal frequency and vertical frequency are within the permissible range (ST202). Herein, the permissible range is inherent to the display device, which may differ according to the circuitry characteristics, specifications, etc. If the input signal is outside the permissible range, a certain error process is carried out (ST203), and if the input signal is within the permissible range, the ratio of conversion is obtained (ST204) in order to judge whether the input signal is displayed in an equal magnification, in enlargement or reduction with respect to the display device 8.

Although it is impossible to obtain the resolution of input signal directly from only the horizontal frequency and vertical frequency, it is possible to obtain the total number of lines of the signal by dividing the horizontal frequency by the vertical frequency. Therefore, the total number of lines is deducted by a certain ratio to obtain the number of display lines of the signal. Since the ratio of the number of display lines to the total number of lines in the input signal is not constant but differs according to signal sources, the number of display lines obtained in ST204 is not accurately coincident with the number of lines of input signal. However, since the resolution of signal sources existing in the market is roughly a predetermined resolution, for example, 640 dots by 480 lines, 800 dots by 600 lines, 1024 dots by 768 lines, 1280 dots by 1024 lines, etc., the processing efficiency is improved if when calculating the number of display lines such a process is carried out where the total number of the calculated value is regarded as the approximate resolution of a plurality of resolutions as described above.

It is possible to obtain a conversion ratio to display picture signals with the number of lines of a display device through comparison of the number of display lines thus obtained with the number of lines of the display device. Furthermore, with the conversion ration, it is judged whether the picture signals are displayed at an equal magnification, or in enlargement or reduction with respect to the number of lines of the display device (ST205).

If the display is performed at an equal magnification, a control signal for instructing an equal magnification setting is outputted to the scanning conversion circuit 4 and PLL circuit 5 (ST206). If the display is performed in enlargement or reduction, a setting signal of the conversion ratio is outputted to the scanning conversion circuit 4 and PLL circuit (ST207).

The scanning conversion circuit 4 inputs digitized picture signals converted in the A/D converter 3 and outputs the signals obtained by multiplying the picture signals by the established conversion ratio, whereby the display is performed. By repeatedly executing a series of processes as described above, it will become possible to display the image at the resolution for a display device with regard to various input signals.

However, since the above mentioned conversion ratio is compared in view of the number of lines, it is preferable that the aspect ratio of the input signal is equal to that of a display device. As a matter of course, if the aspect ratio of the input signal is known beforehand, the conversion ratio for which the conversion of the aspect ratio is taken into consideration may be obtained when obtaining the conversion ratio in ST204.

(Embodiment 2)

Figure 3:
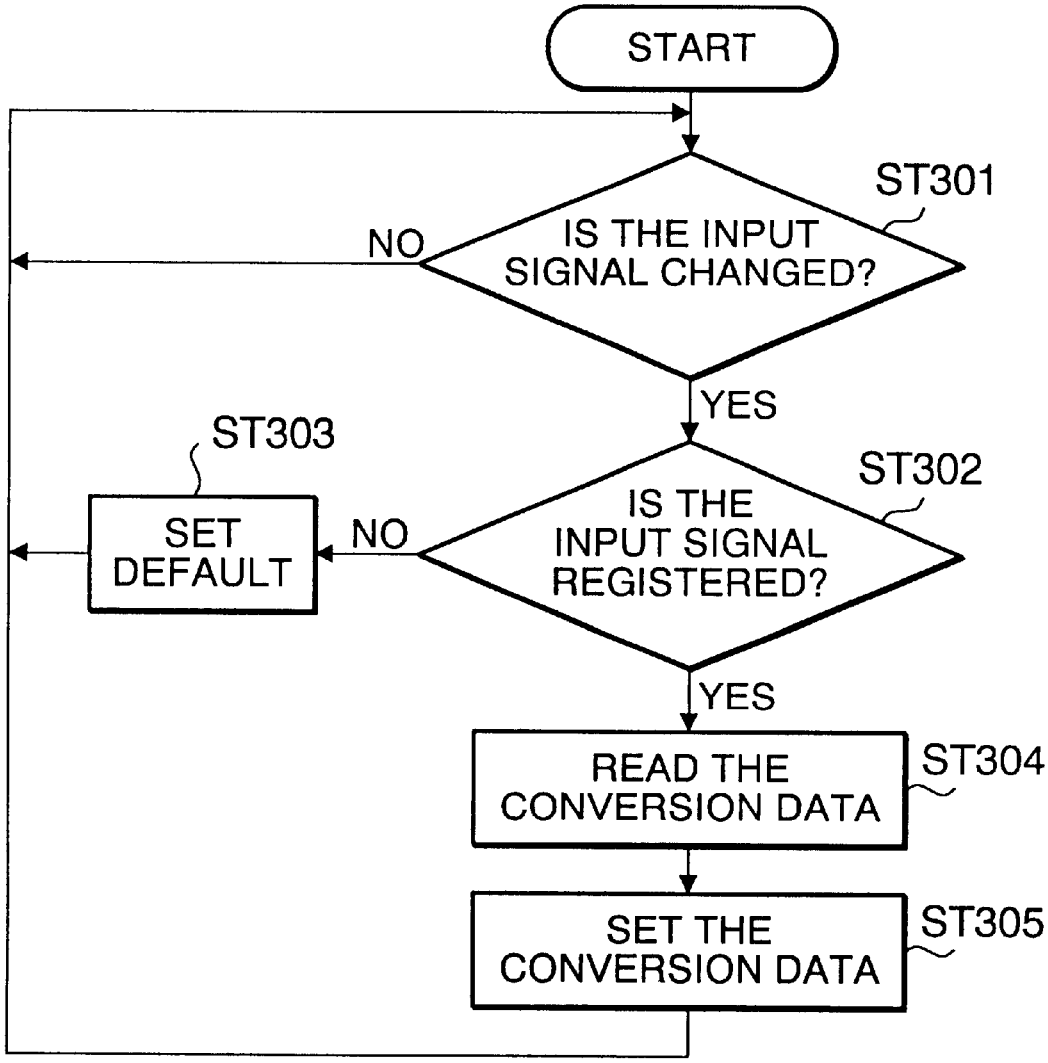
FIG. 3 is a flow chart to explain the function of a second preferred embodiment of a multiscanning type display apparatus according to the invention.

Next, a description is given of the second preferred embodiment of the invention with reference to FIG. 1 and FIG. 3. Since the hardware configuration of the second preferred embodiment is similar to that of the first preferred embodiment, the second preferred embodiment is described with reference to FIG. 1. FIG. 3 is a flow chart to explain the function of the second preferred embodiment of the invention.

Horizontal synchronization signals and vertical synchronization signals are separated from the input signals, which are inputted from the signal source 1 such as a computer, etc., in FIG. 1, by the synchronization separation circuit 2 and are inputted into the microcomputer 7. Furthermore, the polarities of the horizontal synchronization signals and vertical synchronization signals are extracted and inputted. The microcomputer 7 into which these signals are inputted firstly detects the horizontal frequency, vertical frequency and polarities of the horizontal synchronization signals and vertical synchronization signals from the horizontal and vertical synchronization signals, and checks to see whether or not the input signal changes (ST301). Unless the input signal changes, this check is repeated. It is similar to the first preferred embodiment in that turning on the power switch of the display device is regarded as a change of the input signal.

If the input signal changes, the horizontal frequency, vertical frequency, and polarities of the horizontal and vertical synchronization signals are compared with data stored in advance in the memory unit 6, wherein it is checked whether or not the input signals are those registered beforehand (ST302).

Data regarding scanning conversion with respect to various signals, horizontal frequency data, vertical frequency data, horizontal synchronization signal polarity data and vertical synchronization signal polarity data for judging whether or not the input signal is a signal registered in advance are stored in advance in the memory unit 6. A certain default is set if the input signal is outside the registered data (ST303). If the input signal is a registered signal, the data regarding the scanning conversion corresponding to the signal is read from the memory unit 6 (ST304), and is established in the scanning conversion circuit 4 and PLL circuit 5 (ST305). The scanning conversion circuit 4 inputs picture signals digitized by the A/D converter 3, and processes the picture signals in compliance with the established data description, wherein they are outputted to the display device 8 and are displayed thereon. By repeatedly executing the above mentioned steps, it will become possible to display at the resolution for the display device with regard to various input signals.

The data regarding the established scanning conversion includes various kinds of correction data stored in the memory unit 6 in addition to the conversion ratio indicated in the first preferred embodiment. There are various display ranges and phases of picture signals with respect to synchronization signals of input signals, depending upon the signal sources. Therefore, by only setting the conversion ratio, the input signal is not necessarily displayed at 100% on the display area, and there are cases where the amplitude variation and phase variation may be generated. The data is for correcting these situations.

Therefore, if an input signal is specified from the horizontal frequency, vertical frequency, horizontal synchronization signal polarity and vertical synchronization signal, and if the input signal is the signal registered in the memory unit 6, adequate display can be executed on the display area by reading various kinds of correction data pertaining to the display range and phase difference of picture signals corresponding to the input signal when processing the magnification and division of the input signal and executing a correction process.

With only the above mentioned correction data stored in the memory unit 6, the conversion ratio may be obtained by calculation from the horizontal frequency and vertical frequency as in the first preferred embodiment and may be concurrently established.

(Embodiment 3)

Figure 4:
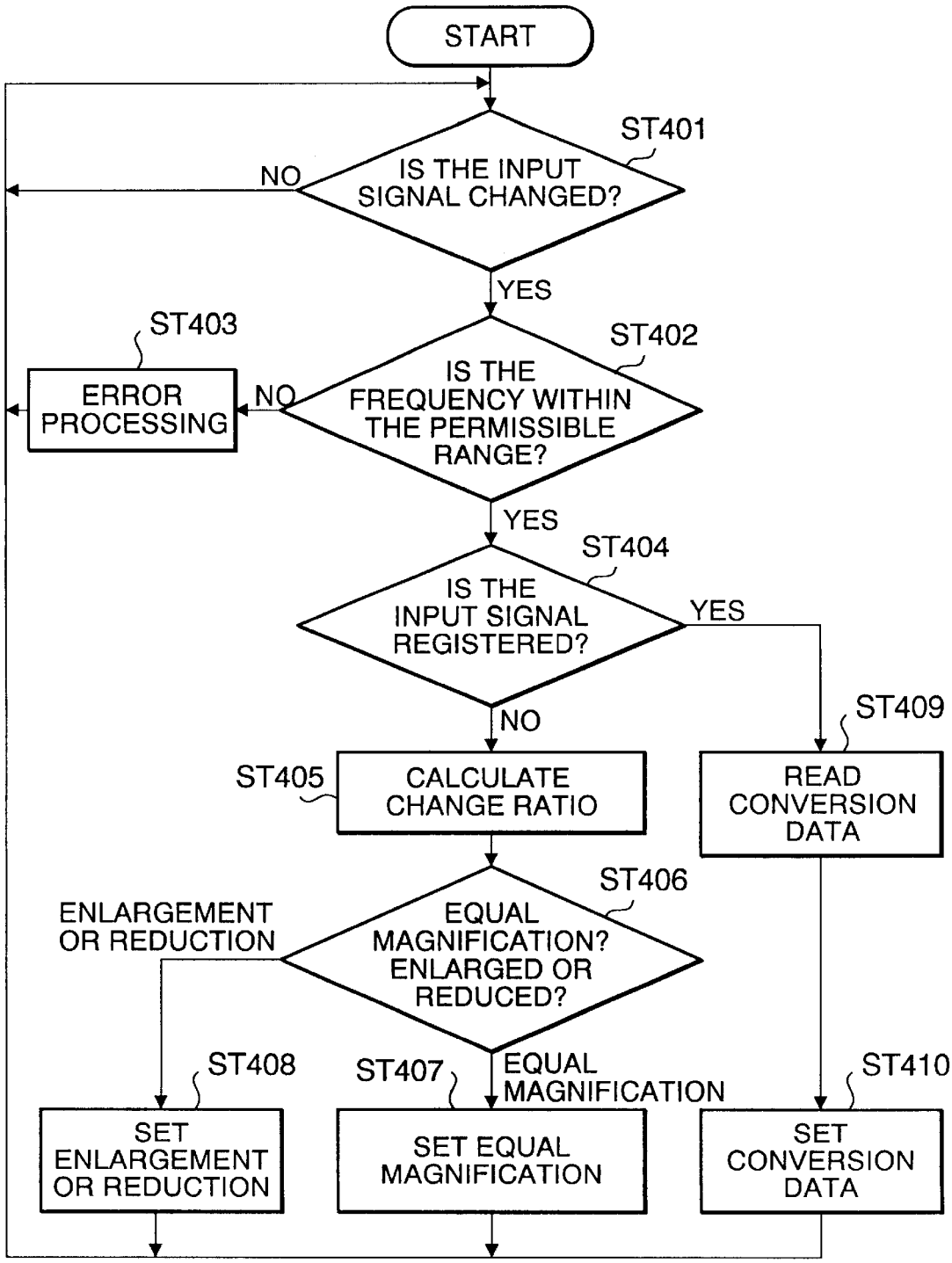
FIG. 4 is a flow chart to explain the function of a third preferred embodiment of a multiscanning type display apparatus according to the invention.

Next, a description is given of the third preferred embodiment of the invention with reference to FIG. 1 and FIG. 4. FIG. 4 is a flow view to explain the function of the third preferred embodiment of the invention. The third preferred embodiment of the invention is a combination of the first and second preferred embodiments.

Horizontal synchronization signals and vertical synchronization signals are separated from the input signals, which are inputted from the signal source 1 such as a computer, etc., in FIG. 1, by the synchronization separation circuit 2 and are inputted into the microcomputer 7. Furthermore, the polarities of the horizontal synchronization signals and vertical synchronization signals are extracted and inputted. The microcomputer 7 into which these signals are inputted firstly detects the horizontal frequency, vertical frequency and polarities of the horizontal synchronization signals and vertical synchronization signals from the horizontal and vertical synchronization signals, and checks to see whether or not the input signal changes (ST401). Unless the input signal changes, this check is repeated.

If the input signal has changed, it is checked whether or not the newly detected horizontal frequency and vertical frequency are within the permissible range (ST402). Herein, the permissible range is inherent to the display device, which may differ according to the circuitry characteristics, specifications, etc. If the input signal is outside the permissible range, a certain error process is carried out (ST403). If the input signal is within the permissible range, the horizontal frequency, vertical frequency, horizontal synchronization signal polarity and vertical synchronization signal polarity are compared with the data stored in advance in the memory unit 6, and it is checked whether or not the input signal is a signal registered beforehand (ST404). Data pertaining to scanning conversion corresponding to a plurality of signals, horizontal frequency data, vertical frequency data, horizontal synchronization polarity data and vertical synchronization polarity data for judging whether or not the input signal is a registered signal are stored in advance in the memory unit 6.

If the input signal is outside the registered signals, it is checked by obtaining the conversion ratio whether the display is executed at an equal magnification, or in enlargement or reduction with respect to a display device 8 (ST405, ST406). The way of obtaining the conversion ratio and method of judgement are identical to those in the first preferred embodiment, and the data is established in the scanning conversion circuit 4 and PLL circuit 5 (ST407, ST408).

If the input signal is a registered signal, the data regarding the scanning conversion of the signal is read from the memory unit 6 (ST409) and is established in the scanning conversion circuit 4 and PLL circuit 5 (ST410). The scanning conversion circuit 4 displays input picture signals of the digitized and inputted by the A/D converter 3 on the display device 8 in compliance with the established data content. By repeatedly executing the above mentioned steps, it will become possible to display the image on the basis of picture signals at the resolution of the display device with respect to various kinds of input signals. Data pertaining to the scanning conversion established by the memory unit 6 is the same as that of the second preferred embodiment.

By combining the first preferred embodiment with the second preferred embodiment as described above, if the input signal is a signal registered in advance in the memory unit 6, it is possible to display picture signals at 100% on the display area, and with regard to signals not registered, it is possible to display them at almost the resolution of the display device although some phase variation of display may arise.

(Embodiment 4)

Next, a description is given of the fourth preferred embodiment of the invention on the basis of FIG. 1 and FIG. 5. Since the hardware configuration of the fourth preferred embodiment is similar to that of the first preferred embodiment, a description is given on the basis of FIG. 1. And FIG. 5 is a flow chart to explain the function of the fourth preferred embodiment of the invention.

The microcomputer 7 checks whether or not the input signal changes (ST501), and the processes (ST507, ST508, ST510) till completion of establishing the conversion ratio and establishing the correction data are similar to steps ST401 to ST410 in FIG. 4.

In this preferred embodiment, after data pertaining to the scanning conversion is established in the scanning conversion circuit 4 and PLL circuit 5, the display adjustment section 9 changes the adjustment items adjustable by a user according to the kinds of input signals on the basis of instructions of the microcomputer 7 (ST511). In detail, the sampling clock adjustment is available only when the display is executed at an equal magnification, and by changing the clock value and phase displayed on the screen, noise can be reduced. However, the case that the adjustment becomes impossible by carrying out once reduction or enlargement by the scanning conversion, the clock value and phase are listed as adjustment items on the screen display only when an equal magnification is set. In all other cases, they are omitted from the adjustment items on the screen display. In this case, where the input signal is a signal registered in the memory unit 6, information of the adjustment items is stored in advance in the memory unit 6, thereby the adjustment items may be established.

What is claimed is:

1. A multiscanning type display apparatus comprising:

a matrix drive type display that has a predetermined number of display lines and displays a picture signal;

a picture signal supplier that supplies the picture signal to the matrix drive type display device;

a synchronization signal supplier that outputs a synchronization signal included in the picture signal;

a frequency extractor that extracts a horizontal frequency and a vertical frequency from the synchronization signal;

a change ratio memory that stores a plurality of change ratios for converting a resolution of the picture signal into a resolution of the matrix drive type display device and a plurality of pairs of a horizontal frequency and a vertical frequency, each of the plurality of change ratios being associated with one of the plurality of pairs of a horizontal frequency and a vertical frequency, each pair corresponding to one of a plurality of resolutions of picture signals supplied by the picture signal supplier;

a change ratio reader that compares at least one of the horizontal and vertical frequencies extracted by the frequency extractor with the plurality of pairs of the vertical frequency and the horizontal frequency stored in the change ratio memory in order to specify the picture signal supplied by the picture signal supplier, and retrieves one of the plurality of change ratios corresponding to the specified picture signal;

a resolution changer that executes a resolution change by multiplying the picture signal by the change ratio retrieved by the change ratio reader;

a total-line-number calculator that calculates a total number of lines of the picture signal by dividing the horizontal frequency by the vertical frequency extracted by the frequency extractor when the change ratio reader does not retrieve one of the plurality of change ratios corresponding to the specified picture signal;

a resolution memory that stores a plurality of numbers of display lines each corresponding to one of a plurality of resolutions used in the picture signal supplier;

a resolution selector that retrieves one of the plurality of numbers of display lines from the resolution memory in accordance with the total number of lines of the picture signal;

a change ratio calculator that calculates a change ratio to convert the number of display lines retrieved by the resolution selector into the predetermined number of display lines of the matrix drive type display device; and the resolution changer further executing the resolution change by multiplying the picture signal by the change ratio calculated by the change ratio calculator.

2. The multiscanning type display apparatus according to claim 1, wherein the change ratio memory further stores correction data in association with each of the plurality of change ratios, the correction data correcting a difference in amplitudes and a difference in phases between the picture signal and the matrix drive type display device, the resolution reader further retrieves the correction data in association with the retrieved change ratio, and the resolution changer further executes a correction process in accordance with the correction data retrieved by the resolution changer.

3. The multiscanning type display apparatus according to claim 1, wherein the frequency extractor further extracts a horizontal synchronization signal polarity and a vertical synchronization signal polarity from the picture signal supplied by the picture signal supplier;

the change ratio memory further stores a plurality of pairs of horizontal signal polarity and vertical synchronization signal polarity, each of the plurality of pairs of the horizontal synchronization signal polarity and vertical synchronization signal polarity being associated with each of the plurality of the change ratios and corresponding to one of the plurality of resolutions of picture signals supplied by the picture signal supplier;

the change ratio reader further compares at least of the horizontal and vertical synchronization signal polarities extracted by the frequency extractor with the plurality of pairs of the vertical synchronization signal polarity and the horizontal synchronization signal polarity stored in the change ratio memory in order to specify the picture signal supplied by the picture signal supplier.

4. A display method for a matrix drive type display that has a predetermined number of display lines and displays a picture signal produced by a picture signal source, the method comprising:

extracting a horizontal frequency and a vertical frequency from a synchronization signal included in the picture signal;

comparing the horizontal and vertical frequencies extracted from the synchronization signal with a plurality of change ratios stored in a memory in order to specify the picture signal, the memory storing the plurality of change ratios for converting a resolution of the picture signal into a resolution of the matrix drive type display and a plurality of pairs of horizontal frequency and the vertical frequency, each of the plurality of change ratios being associated with one of the plurality of pairs of a horizontal frequency and a vertical frequency, each pair corresponding to one of a plurality of resolutions of picture signals supplied by the picture signal source;

retrieving one of the plurality of change ratios stored in the memory corresponding to the specified picture signal;

executing a resolution change by multiplying the picture signal by the retrieved change ratio;

calculating a total number of lines of the picture signal by dividing the extracted horizontal frequency by the vertical frequency, when retrieving fails to retrieve one of plurality of change ratios stored in the memory corresponding to the specified picture signal;

selecting one from a plurality of numbers of display lines stored in a resolution memory in accordance with the calculated total number of lines of the picture signal, each of the plurality of numbers of display lines corresponding to one of a plurality of resolutions used in the picture signal source;

calculating a change ratio to convert the selected number of display lines into the predetermined number of display lines of the matrix drive type display device; and executing a resolution change by multiplying the picture signal by the calculated change ratio.

* * * * *

UNITED STATES PATENT AND TRADEMARK OFFICE

CERTIFICATE OF CORRECTION

PATENT NO. : 6,333,751 B1
DATED : December 25, 2001
INVENTOR(S) : H. Torii et al.

It is certified that error appears in the above-identified patent and that said Letters Patent is hereby corrected as shown below:

Column 8,
Line 7, after "least" insert -- one --.
Line 46, after "of" insert -- the --.

Signed and Sealed this

Thirtieth Day of July, 2002

*Attest:*

*Attesting Officer*

JAMES E. ROGAN
*Director of the United States Patent and Trademark Office*